US006881903B2

(12) United States Patent
Greiner et al.

(10) Patent No.: US 6,881,903 B2
(45) Date of Patent: Apr. 19, 2005

(54) MULTI CONDUCTOR ARRANGEMENT FOR TRANSFERRING ENERGY AND/OR DATA

(75) Inventors: Robert Greiner, Baiersdorf (DE); Toni Kress, Lauf (DE); Manfred Ochsenkühn, Berg (DE)

(73) Assignee: Siemens Aktiengesellschaft, Munich (DE)

( * ) Notice: Subject to any disclaimer, the term of this patent is extended or adjusted under 35 U.S.C. 154(b) by 27 days.

(21) Appl. No.: 10/381,796

(22) PCT Filed: Apr. 15, 2002

(86) PCT No.: PCT/DE02/01392

§ 371 (c)(1),
(2), (4) Date: Mar. 28, 2003

(87) PCT Pub. No.: WO02/086914

PCT Pub. Date: Oct. 31, 2002

(65) Prior Publication Data

US 2005/0006133 A1 Jan. 13, 2005

(30) Foreign Application Priority Data

Apr. 20, 2001 (DE) ..... 101 19 653

(51) Int. Cl.[7] ..... H01B 7/00
(52) U.S. Cl. ..... 174/113 R; 174/115; 174/117 F
(58) Field of Search ..... 174/117 F, 115, 174/113 R, 112

(56) References Cited

U.S. PATENT DOCUMENTS 4,443,657 A 4/1984 Hill et al.
4,576,662 A * 3/1986 Lemke ..... 156/52
5,268,531 A * 12/1993 Nguyen et al. ..... 174/36
5,463,186 A * 10/1995 Schricker ..... 174/36
6,084,181 A * 7/2000 Lilienthal et al. ..... 174/115
6,103,976 A 8/2000 Kobayashi et al.

FOREIGN PATENT DOCUMENTS

| | | | |
|---|---|---|---|
| DE | 24 59 069 | | 7/1975 |
| DE | 35 27 847 | | 2/1987 |
| DE | 40 04 229 | | 8/1991 |
| DE | 297 09 748 | | 9/1997 |
| DE | 200 16 527 | U1 | 11/2000 |
| WO | WO 00/07196 | * | 2/2000 |

* cited by examiner

*Primary Examiner*—Chau N. Nguyen
(74) *Attorney, Agent, or Firm*—Young & Thompson

(57) ABSTRACT

A multi conductor (L) arrangement for transferring energy and/or data. The system contains a plurality of conductor elements (1*i*) respectively comprising a conductor (1A) which is surrounded by an insulation (2) and an insulating sleeve (3), the conductor elements being mechanically connected to each other. Elements (12) for contacting the conductive elements are also provided. The system is provided with a flexible tubular or pipe-shaped support (10) made of an insulating material having a maximum thickness (D) of 1 mm, the conductive elements (1I) are arranged on the inside wall of the support, and the insulating sleeves (3) of the conductive elements have a respective thickness (d) which is at the most equal to the thickness (D) of the support. A thermoplastic elastomer is preferably used as an insulating material.

20 Claims, 2 Drawing Sheets

MULTI CONDUCTOR ARRANGEMENT FOR TRANSFERRING ENERGY AND/OR DATA

CROSS REFERENCE TO RELATED APPLICATIONS

This is the 35 USC 371 national stage of international application PCT/DE02/01392 filed on Apr. 15, 2002, which designated the United States of America.

FIELD OF THE INVENTION

The invention relates to a multiconductor arrangement for power and/or data transmission having a number of conductor elements, which each have a metallic conductor core with core insulation and, furthermore, an insulating sheath, and are mechanically connected to one another. Means are also provided for making contact with the conductor elements.

BACKGROUND OF THE INVENTION

Conductor arrangements or systems for power transmission and/or for data transmission of a flat type, and which are also referred to as power bus systems or data bus lines, are frequently used nowadays for the electrical connection of various end loads such as motors, actuators, sensors or controllers. These conductor arrangements are normally in the form of multicore/polycore, rubber-insulated or plastic-insulated flat cables. In this case, the conductor arrangements generally have double insulation, namely individually for each transmission conductor that forms a conductor element, and for the entire system as an entity. In this case, in known power bus systems, the layer thicknesses for the insulating sheaths of the individual conductor elements are at the moment more than 0.8 mm, while the outer insulation for the entire line is more than 1.2 mm thick.

However, a configuration such as this for such a multiconductor arrangement results in a number of difficulties:

a) the relatively thick walls mean that complex contact-making mechanisms have to be designed and provided. This leads to a time-consuming contact-making process. Furthermore, the product is very stiff, with relatively poor flexibility. This is associated with problems in routing and with small bending radii.

b) The flat structure leads to relatively costly and time-consuming laying mechanisms, for example when passing them through walls or entries into switchgear cabinets. This is because slotted bushings have to be provided there, with a size matched to the flat structure.

c) In the case of a through-contact, for example by means of an insulation-displacement terminal technology which is known per se, it is necessary to pass through relatively thick layers; this means that correspondingly high forces need to be applied. Furthermore, it is necessary to comply with extremely tight tolerances between the positions of the individual conductor elements in corresponding bus lines, in order that the through-contact makes contact with the respective conductor element centrally.

d) The flat structure means that bends are generally possible only over the flat edge. On-edge bending is virtually impossible, since the so-called aspect ratio (width to thickness of the bus system) is very high. Thus, for example in the case of a known rubber-insulated flat cable with seven conductor elements whose cross section is 4 $mm^2$ each, the ratio of the width to the thickness is about 5 to 1.

e) When using corresponding flat cables in the North-American market, the conductor arrangement—also in the form of a flat cable—must be drawn through a tube in accordance with UL/CSA, for protection reasons. This is extremely complex for flat cables.

Owing to the abovementioned difficulties, known flat cables are predominantly used on straight connecting paths or those with relatively large bending radii. The cables are in this case cut through at the end load, are individually stripped, and are made contact with there.

SUMMARY OF THE INVENTION

The object of the present invention is therefore to specify a multiconductor arrangement having the features mentioned initially, but in which the difficulties mentioned above are at least reduced.

According to the invention, this object is achieved by the measures specified below. In a corresponding manner, the multiconductor arrangement for power and/or data transmission having a number of conductor elements which each have a metallic conductor core with core insulation and, furthermore, an insulating sheath and which are mechanically connected to one another, and with means for making contact with the conductor elements, has the following features, namely

- a support which is in the form of a tube or flexural tube and is composed of insulating material with a thickness of at most one millimeter, and
- a number of conductor elements, which are arranged on the inside of the support and whose insulating sheaths each have a thickness, which is at most equal to the thickness of the support.

The advantages which are associated with this refinement of the multiconductor arrangement are, in particular, that designing a bus system (power bus/data bus) with thin-layer insulation and with a round structure considerably simplifies the laying of the bus system. Instead of complex slotted apertures in masonry or complicated plug-in systems in switchgear cabinets, the new multiconductor arrangement can now be laid through simple round holes, which can be produced quickly. In this case, the conductor arrangement is easy to lay, in a similar manner to a normal round cable. Since the multiconductor arrangement with a round design is considerably less stiff, relatively small bending radii can be produced during laying work.

In contrast to the previously used conductor arrangements of a flat type, the embodiment of the arrangement according to the invention using thin layer technology leads to the wall thickness of the insulation of the individual conductor elements, and of the outer insulation that is used as a support, being reduced considerably.

Furthermore, the intended thin layer insulation allows contact to be made more easily and more reliably especially when using modern through-contact-making techniques such as insulation-displacement terminal technology, since less force now be applied to pass through the outer support insulation and the conductor element insulation. Furthermore, contact with the respective conductor element can be made centrally in a simple manner.

The thinner walls result in further advantages in the consumption of insulation materials, and in cost and weight savings associated with this, as well as smaller dimensions in the logistic field, when providing relatively large quantities of the multiconductor arrangement. In the event of a fire, the thinner walls also considerably reduce the fire hazard.

Advantageous refinements of the multiconductor arrangement according to the invention are described in the dependent claims.

By way of example, the material of the support and the material of the sheaths of the conductor elements can be fused to one another on the inside of the support in the area where the surface parts rest against one another. An attachment for the conductor elements of this type can be achieved by suitable material selection of the support material and of the sheath material. These parts of the conductor arrangement are preferably fixed such that the sheaths and the outer support are produced in a joint method step, for example in the course of an extrusion process.

Furthermore, the sheathing material and the core insulation material may be chosen such that the conductor cores which are sheathed with the core insulation can at least partially move (with respect to the inside of the sheath especially in the longitudinal direction) in their respective sheath. This therefore makes it possible to ensure that the conductor arrangement is highly flexible.

Furthermore, it may be regarded as particularly advantageous for the insulator material of the sheaths of the conductor elements and/or of the support to be a thermoplastic elastomer. Materials such as these with predetermined thin walls may be used with the technology that is known per se. They are highly, flexible and also allow a good mechanical connection, between the support and the sheath conductor elements, for example by forming the support and sheaths jointly.

Additional (auxiliary) cables can also advantageously be accommodated in the interior that is enclosed by the support, in addition to the conductor elements for power and/or data transmission. For example, in addition to the power cables, further data lines, auxiliary power cables (for example for low-voltages) or hollow conductors for gaseous (for example compressed air) and/or liquid media (for example hydraulic fluid) can be integrated in the conductor arrangement. This thus results in a multimedia line. In this case, the wall thicknesses of the additional hollow cores can be designed to be thicker, in accordance with the requirements. Optical waveguides may also run in the interior, and can advantageously be laid such that they are protected by the support, which acts as a casing.

Further advantageous refinements of the multiconductor arrangement can be found in the dependent claims which have not been referred to above.

BRIEF DESCRIPTION OF THE DRAWINGS

The invention will be explained in more detail in the following text with reference to exemplary embodiments. In this case, FIGS. 1 to 4 of the drawing each show, schematically and in the form of a cross section, one embodiment of a multiconductor arrangement according to the invention, in particular as a multimedia line in the closed state (parts a) and in the disconnected state (parts b).

The designations in the figures are as follows:

Figures 1, 2:
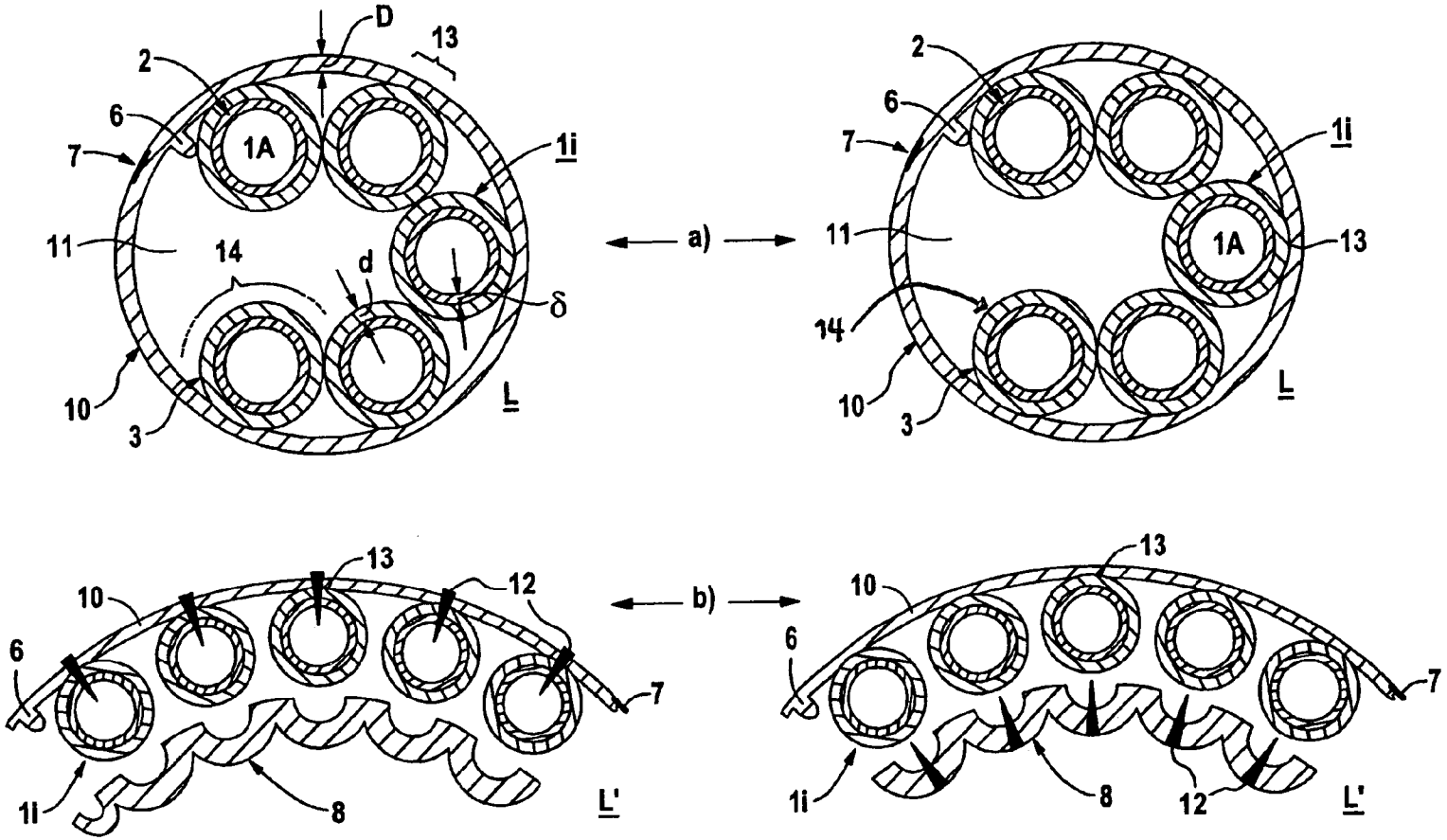

1*i* single core or multicore conductor elements, 1A Conductor cores,
2 Core insulation on these conductor elements,
3 Conductor element sheaths,
4 Hollow cores,
5 Optical waveguides,
6 A marking element,
7 An opening aid,
8 A contact-making aid,
9*j* Single core or multicore conductor element,
10 A support,
11 A support interior,
12 Contact-making pins,
13 Connecting areas,
14 Free surface areas of the sheaths,
L Conductor arrangements (in the closed round form),
L' Conductor arrangements (in the disconnected state),
δ The thickness of the core insulation,
d The thickness of the conductor element sheaths, and
D The thickness of the support.

DETAILED DESCRIPTION OF THE INVENTION

The parts a in the figures each show the cross section through the multiconductor arrangement, which forms a round conductor, with a closed casing-like support 10, while the parts b of the figures each show, at least partially, the round conductor which is, for example, disconnected in one end area. In this case, a number of conductor elements 1*i* or 9*j* are firmly connected on the inside of the support to the casing-like support 10 of the multiconductor arrangements, which are denoted by L in the parts a and by L' in the parts b. The corresponding fixing is in this case provided between the material of the element sheaths 3 and the material of the support 10. In one preferred embodiment, on which the figures in the following text are based, the support and the sheaths are composed of the same material. The support 10 and the sheaths 3 can advantageously be formed at the same time using this material in a single process step, in particular such as an extrusion step, by means of an appropriate tool. However, other types of attachment are also possible for the conductor elements 1*i* and 9*j*, such as a subsequent adhesive bonding technique or a fusion technique in the connecting areas 13. These areas are then also referred to in the following text as casings/web areas, while the free surface areas of the, sheaths 3 outside these connecting areas are denoted by 14.

The conductor cores 1A are known metallic wires, which may also be composed of a number of conductors or filaments which can be braided with one another or can be formed into a bundle in some other way. These conductor cores are each sheathed in a known manner by core insulation 2 with the thickness 8, which should at most be equal to the thickness d of the element sheath 3 surrounding it. The material of the core insulation may in this case be different to that of the sheath. The conductor cores 1A with their insulation 2 are prefabricated, before they are provided with their sheaths 3.

As can be seen from the parts b, the individual conductor elements 1*i* and 9*j* are each made contact with by a contact-making pin 12 using an insulation-displacement terminal technique. Specifically, in order to make contact, the conductor arrangement (which is disconnected at one end by way of example and is denoted in general by L') is placed in a flat or half-round, modular contact-making aid 8, whose groove-like openings are matched to the respective conductor shape and size or diameter. The support 10 or support tube that is fitted with the conductor elements is, disconnected in the longitudinal direction of the tube in a manner known per se by means that are suitable for, this purpose. By way of example, the support may be provided with a connecting part which can be detached in the circumferential direction. An appropriate weak point can either be made identifiable visually by means of a marking which is generally referred to as an opening aid 7—for example by means of the support having a different color—or this may be achieved physically—for example by means of a small groove or projection. This can be seen on the outside of the support 10 in the illustrated embodiments. There, the round conductor which forms the conductor arrangement L is cut open and is fixed as a flat or half-round cable L' in the modular contact-making aid 8.

Figures 3, 4:
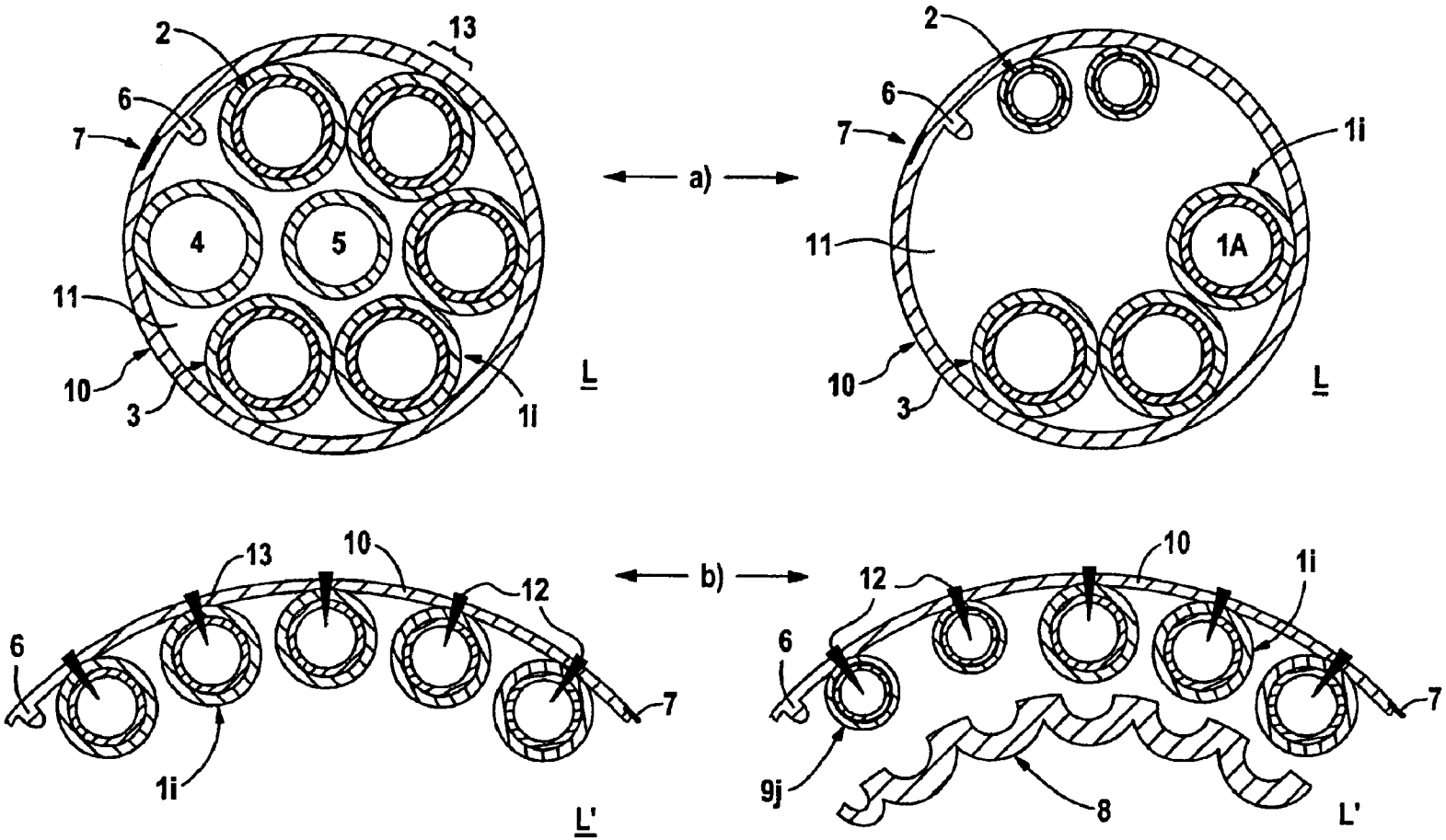

Contact can then be made optionally from above (see FIGS. 1*b*, 3*b* and 4*b*) or, if required, also from underneath (see FIG. 2*b*), preferably using insulation displacement terminal technology. In order to make it possible to ensure that contact is undoubtedly made with the correct individual conductor elements, at least one marking must be provided on them or on the support 10. A marking such as this may intrinsically be provided by differently colored sheaths 3 on the individual conductor elements 1*i* and 9*j*. However, it is also possible to provide a special marking element, with respect to which the position of the individual conductor elements is clear. The figures each show a corresponding exemplary embodiment in their part b. The marking element 6 which forms a mechanical code, for example in the form of an additional web at the weak point, is accordingly located on the inside of the support 10. This means that there is only a single possible way to fix the conductor arrangement L' in its disconnected area in the contact-making aid 8. Incorrect connections during connection, of the individual conductor elements are thus impossible. When making contact by means of insulation-displacement terminal technology, a further advantage is that the individual conductor elements 1*i* and 9*j* are connected to one another by means of a single-sided (support) casing/web structure, and the insulation on the conductor elements in the area 14 away from the web can once again be formed to be considerably thinner than in the casing/web area 13.

When contact is made from underneath, as can be seen from part b of FIG. 2, comparatively little, insulating material need be passed through. Since the individual conductor elements are highly mobile by virtue of the particular single-sided casing/web structure, it is possible to work with considerably wider tolerances in the position of the conductor element with respect to one another. Nevertheless, the contact is always made centrally in the conductor element via the guides in the modular contact-making aid B. Furthermore, the direct contact with the respectively required outgoing lines at the contact-making pins 12 reduces any heat losses.

In contrast to the previously used bus systems, the embodiment of the conductor arrangement according to the invention using thin layer technology leads to a considerable reduction in the wall thicknesses of the insulation on the individual conductor elements 1*i* and 9*j*, as well as of the support insulation. In general, it can be said for multiconductor arrangements according to the invention that the thickness D of the support casing is at most 1 millimeter, and the thickness d of the sheaths 3 is also at most as great. A value of at most 1 millimeter should likewise be chosen for the thickness 8 of the core insulation 2. The layer thickness δ of the core insulation may advantageously be between 0.05 and 0.5 mm, and is preferably 0.1 to 0.3 mm. In contrast, the layer thickness D (=wall thickness) of the support casing insulation in the casing/web area 13 is between 0.5 and 1 mm, and preferably between 0.6 and 0.8 mm, while this thickness in the area away from the web may be between 0.1 and 0.5 mm, and is preferably between 0.2 and 0.4 mm.

The thin layers are preferably produced by the use of flexible insulator materials, which are known per se, based on thermoplastic elastomers (TBE), which may have a characteristic profile which corresponds to the respective requirement profile. For the insulating materials, which should advantageously be chosen to be the same for the conductor elements and for the support casing, these are preferably thermoplastic elastomers based on polyolefins (TPE-O), polyamides (TPE-A), polyurethanes (TPE-U), styrene copolymers (TPE-S), styrene/butadiene/styrene block polymers (S/B/S), styrene/ethylene butylene/styrene block polymers (S/EB/S) and ethylene vinyl acetate (E/V/A). However, in principle, it is also possible to choose other conventional insulator materials rather than these elastomers, such as other thermoplastics or rubber-like materials.

The thermoplastic elastomers which are used by preference may be processed considerably more economically in an extrusion process than the previously used materials, in particular those based on rubber, since now, by way of example, there is no longer any need for an additional cross-linking step, and it is possible to achieve comparatively better production rates. Since the thermoplastic elastomers which have been mentioned can be set such that they are not crosslinked, are free of halogens and are flame-resistant, this also makes it possible to ensure that they can be recycled without any problems. In comparison to known bus lines based on crosslinked, partially halogenized rubber mixtures, the conductor arrangement according to the invention is thus distinguished by being highly environmentally friendly.

A smooth external contour on the support 10 furthermore ensures that it is easy to clean. This is of particularly major importance for applications in the foodstuffs area. A smooth external contour also allows the use of conventional screw connections, by which means it is once again possible to achieve a high ingress protection class (>IP 67) as standard.

In principle, two production variants can be provided for conductor arrangements according to the invention, namely:

1. the illustrated version of a closed round cable with a weak point in one manufacturing step,
2. the extrusion of the cable in the described single-sided casing/web structure using thin layer technology and in a flat or half-round configuration. In this version, a mechanical connecting device in the form of a "zip fastener system" can be physically integrated in the, longitudinal direction of the arrangement. In a second step after extrusion, the conductor arrangement is then introduced into the round cable with the aid of this zip fastener.

Depending on the embodiment, a cavity or channel in which further cables may be laid is formed in the interior 11 of the round structure of the conductor arrangement L. For example, when using a power bus, it is possible to lay additional sensitive data lines such as optical waveguides 5 in a protected manner. Hollow conductors 4 for carrying gaseous substances such as compressed air and/or liquid media such as hydraulic fluid can also be integrated in the conductor arrangement, if required (see FIG. 3).

The multiconductor arrangement according to the invention may be designed for all conventional conductor element cross sections or conductor core cross sections, namely those with cross sections of 1.5, 2.5, 4 or 6 $mm^2$. In this case, as shown in the embodiment in FIG. 4, different conductor cross sections of conductor elements 1*i* and 9*j* may also be combined with one another in one conductor arrangement L.

According to one specific embodiment of a multiconductor arrangement as shown in FIG. 1, each conductor core 1A of its five conductor elements 1*i* is formed from one or more copper conductors, with each conductor core having a metallic cross-sectional area of 4 $mm^2$. The conductor cores of each of the five elements are each surrounded by tubular core insulation 2 with a thickness δ of 0.1 and 0.3 mm. This core insulation is itself sheathed by a sheath 3 composed of thermoplastic elastomer insulator material with a thickness d of at most 0.5 mm. The insulator (outer) casing of the support 10, which is likewise composed of the same thermoplastic elastomer material as the sheaths 3, has a thickness D of between 0.5 and 0.8 mm. The external diameter of the support is then approximately 14 mm.

Furthermore, the figures have been based only on embodiments of multiconductor arrangements L or L' with conductor elements 1*i* and 9*j* whose core insulation 2 is permanently surrounded by the material of the respective element sheath 3. However, such fixing of the conductor cores that are surrounded by the core insulation within the sheaths is not absolutely essential for multiconductor arrangements according to the invention. This is because the material for the core insulation and for the sheaths for the production of the multiconductor arrangement may be chosen to at least partially prevent such a firm connection between these parts. This thus results in the advantage of increased mobility of the conductor cores, or the conductor cores being able to move to a greater extent, and hence improved flexibility of the entire structure of the multiconductor arrangement.

What is claimed is:

1. A multiconductor arrangement for either of power and data transmission, comprising:

an outer tube support (10) of a first insulating material and with a thickness (D) of no more than one millimeter;

means for separating the support at a predetermined separation point;

an opening air (7) at the separation point;

plural conductor elements (1*i*, 9*j*);

an outer sheath (3) mechanically joining each of the plural conductor elements to the outer support at connecting areas (13), the outer sheathes being of the first insulating material and having a thickness (d) no more than the thickness of the outer support;

at least some of the conductor elements having a metallic conductor core (1A) and a core insulation (2), of a second insulating material, the core insulation being intermediate the conductor core and the outer sheath; and contact-making pins (12), each pin passing through the outer support (10), passing through one outer sheath (3), and passing through a corresponding one core insulation (2) of a corresponding conductor element (1*i*, 9*j*).

2. The multiconductor arrangement as claimed in claim 1, characterized in that the first material of the sheaths (3) of the conductor elements (1*i*, 9*j*) and the first material of the support (10) are fused to one another at the connecting areas.

3. The multiconductor arrangement as claimed in claim 1, characterized in that the conductor cores (1A) which are sheathed with the core insulation (2) can at least partially move in the corresponding sheath (3).

4. The multiconductor arrangement as claimed in claim 1, characterized by the support (10) being connected in a detachable manner in the circumferential direction.

5. The multiconductor arrangement as claimed in claim 1, characterized by a marking of the individual conductor elements (1*i*, 9*j*).

6. The multiconductor arrangement as claimed in claim 5, characterized by the conductor elements (1*i*, 9*j*) having differently colored sheaths (3).

7. The multiconductor arrangement as claimed in claim 5, characterized by the individual conductor elements (1*i*, 9*j*) being in a predetermined position with respect to a marking element (6) at the separation point of the support (10).

8. The multiconductor arrangement as claimed in claim 1, characterized in that the first insulating material.

9. The multiconductor arrangement as claimed in claim 1, characterized in that, in addition to the conductor elements (1*i*, 9*j*), additional lines (4, 5) are accommodated in the interior (11) which is enclosed by the support (10).

10. The multiconductor arrangement as claimed in claim 1, characterized by a modular contact-making aid (B) which fixes the conductor elements (1*i*, 9*j*) when the support (10) is in the disconnected state.

11. The multiconductor arrangement as claimed in claim 1, characterized by the support (10) having a thickness (D) of between 0.5 and 0.8 mm.

12. The multiconductor arrangement as claimed in claim 1, characterized in that the thickness (δ) of the core insulation (2) is in each case at most equal to the thickness (d) of the corresponding sheath (3).

13. The multiconductor arrangement as claimed in claim 12, characterized by the core insulation (2) of the conductor elements (1*i*, 9*j*) having a thickness (δ) of between 0.05 and 0.5 mm.

14. The multiconductor arrangement as claimed in claim 1, characterized by at least some of the conductor cores having a number of wires or filaments which are surrounded by the core insulation (2).

15. The multiconductor arrangement of claim 1, wherein the core insulation (2) has a thickness between 0.1 and 0.3 mm.

16. A multiconductor arrangement, comprising:

an outer tube support (10) of a first insulating material;

means for separating the support at a separation point;

an opening air (7) at the separation point;

plural conductor elements (1*i*, 9*j*);

an outer sheath (3) mechanically joining each of the conductor elements to the outer support at connecting areas (13), the outer sheathes being of the first insulating material and having a thickness (d) no more than the thickness of the outer support;

plural ones of the conductor elements having a metallic conductor core (1A) and a core insulation (2), of a second insulating material, the core insulation being intermediate the conductor core and the outer sheath; and contact-making pins (12), each pin passing through the outer sheath (3) and corresponding core insulation (2) of the plural conductor elements having a metallic conductor core.

17. The multiconductor arrangement of claim 16; one of the conductor elements has a non-metallic core.

18. The multicondutor arrangement of claim 17, wherein, the non-metallic core comprises a hollow core element for transporting a fluid.

19. A multiconductor arrangement, comprising:

an outer tube support (10) of a first insulating material;

plural conductor elements (1*i*, 9*j*);

an outer sheath (3) mechanically joining each of the conductor elements to the outer support at connecting areas (13), the outer sheathes being of the first insulating material;

means for separating the support at a separation point;

a marking element (6) at the separation point, with individual conductor element being in a predetermined position with respect to the marking element;

plural ones of the conductor elements having a metallic conductor core (1A) and a core insulation (2), of a second insulating material, the core insulation being intermediate the conductor core and the outer sheath;

contact-making pins (12), each pin passing through the outer sheath (3) and corresponding core insulation (2) of the plural conductor elements having a metallic conductor core.

20. The multiconductor arrangement as claimed in claim 19, characterized by an opening air (7) at the separation point.

* * * * *